United States Patent [19]

Scheurecker et al.

[11] 4,129,173

[45] Dec. 12, 1978

[54] CONTINUOUS CASTING PLANT

[75] Inventors: Werner Scheurecker, Linz; Reinhard Hargassner, Leonding, both of Austria

[73] Assignee: Vereinigte Osterreichische Eisen-und Stahlwerke - Alpine Montan Aktiengesellschaft, Linz, Austria

[21] Appl. No.: 809,693

[22] Filed: Jun. 24, 1977

[30] Foreign Application Priority Data

Jul. 8, 1976 [AT] Austria ..... 4999/76

[51] Int. Cl.[2] ..... B22D 11/14

[52] U.S. Cl. ..... 164/442; 164/418; 164/441

[58] Field of Search ..... 164/82, 441, 442, 447, 164/448, 418, 425

[56] References Cited

U.S. PATENT DOCUMENTS 3,718,177 2/1973 Wagner ..... 164/442

3,765,470 10/1973 Huber ..... 164/425

*Primary Examiner*—Francis S. Husar
*Assistant Examiner*—K. Y. Lin
*Attorney, Agent, or Firm*—Brumbaugh, Graves, Donohue & Raymond

[57] ABSTRACT

A continuous casting plant has a frame-shaped lifting table, a mould insertable in the lifting table, and a strand guide device following the mould and including strand guide parts. The strand guide part following the mould is surrounded by a carrying frame, and this strand guide part and the carrying frame are installable in and removable from the continuous casting plant together. The carrying frame is arranged with play in the lifting table and is vertically movable therethrough together with the pertaining strand guide part. On the mould and on the carrying frame, supporting faces opposing each other with play are provided and can engage each other when the carrying frame is lifted.

7 Claims, 4 Drawing Figures

CONTINUOUS CASTING PLANT

BACKGROUND OF THE INVENTION

The invention relates to a continuous casting plant having a mould, which can be inserted in a frame-shaped lifting table, and a strand guide means following the mould. A part of the strand guide means neighbouring the mould is surrounded by a carrying frame and is installable and removable therewith, together with the mould, into and out of the continuous casting plant.

In continuous casting plants, the parts which are subjected to the greatest thermal wear and thus have to be exchanged most frequently, are the mould and the part of the strand guide means following the mould. Therefore, it is desirable to be able to remove these parts quickly and easily in case of damage and to exchange them for new parts. In particular, when the strand breaks through, a quick exchange of the parts is of special importance and furthermore it is advantageous if no manipulations by hand need be carried out in the vicinity of the breakthrough area, which area is usually slightly below the mould.

From Austrian Pat. No. 323,920 it is known to connect the part of the strand guide following the mould with the lifting table by means of coupling elements so as to permit a mutual removal of these parts, i.e. a perpendicularly upward lifting of the unit formed by the mould, the lifting table and the strand guide part in order that they may be taken out of the plant. With this arrangement it is a disadvantage that prior to removal of this unit the coupling elements must be brought into engagement with one another and the water supply, as well as the reciprocating drive for the mould, must be detached from the lifting table. This operation requires manipulations by hand and hampers a quick removal or exchange of this unit. A further disadvantage consists in that the unit to be removed includes the lifting table, so it is heavy and bulky and storing is costly. However the lifting table, which compared to the mould is subjected to comparatively little wear, is not damaged in most cases and does not need to be exchanged.

From German Offenlegungsschrift No. 1,957,689 it is furthermore known to arrange the strand guide part neighbouring the mould within a frame which serves as a carrier for the mould lifting table with the mould. In order to remove the mould together with the strand guide part neighbouring the mould, in this plant the lifting table also has to be removed, and thus this construction also has the above-described disadvantages.

SUMMARY OF THE INVENTION

The invention aims at avoiding these disadvantages and difficulties and has as its object to provide a continuous casting plant of the above-defined kind which makes it possible to remove the mould together with the part of the strand guide following the mould, with no manipulations being necessary on the lifting table and on the reciprocating drive, and wherein the lifting table can remain in the continuous casting plant.

According to the invention, this object is achieved in that a carrying frame is arranged with play within the frame of the lifting table and, together with the part of the strand guide means following the mould, the carrying frame is vertically movable through the frame of the lifting table. On the mould and on the carrying frame there are supporting faces arranged opposite each other with play, which faces come into engagement with each other when the carrying frame is lifted.

Advantageously, the upper end of the carrying frame extends up to the upper rim of the mould and can be brought into engagement with a lift-out means, and thus the removal and installation can be effected from the casting platform alone.

Suitably, the carrying frame and the strand guide means following the mould are united to a structural unit, which results in an especially rigid construction of the part of the strand guide following the mould.

According to a preferred embodiment, the part of the strand guide following the mould is pivotally arranged in the carrying frame so as to free an introduction opening for the starter bar.

It is an advantage if the part of the strand guide following the mould is pivotable by means of a stationary hinged adjustment drive, such as a pressure medium cylinder, whose end that is hinged to the strand guide part is both articulately connected with an arm that is pivotable about a stationary axis and mounted in a downwardly open guide rail secured to the part following the mould. When the part of the strand guide following the mould is removed, the pressure medium cylinder remains fixed in a position in which the installation can take place, so that the exchange of the strand guide part can take place without manipulations being necessary on the strand guide part to be removed.

Furthermore, it is suitable to arrange the supports forming a side of the carrying frame to be pivotable transversely to the cast strand, whereby the rollers of the strand guide part arranged in the carrying frame are more easily accessible.

For checking the position of the mould relative to the strand guide part arranged in the carrying frame, the carrying frame is provided with vertical and horizontal finely machined faces that are each arranged with play opposite vertical and horizontal finely machined faces of the mould. The distance between these finely machined faces can be precisely measured and corrected, if desired.

BRIEF DESCRIPTION OF THE DRAWINGS

The invention shall now be described in more detail by way of two embodiments and with reference to the accompanying drawings, wherein.

DESCRIPTION OF EXEMPLARY EMBODIMENTS

Figure 1:
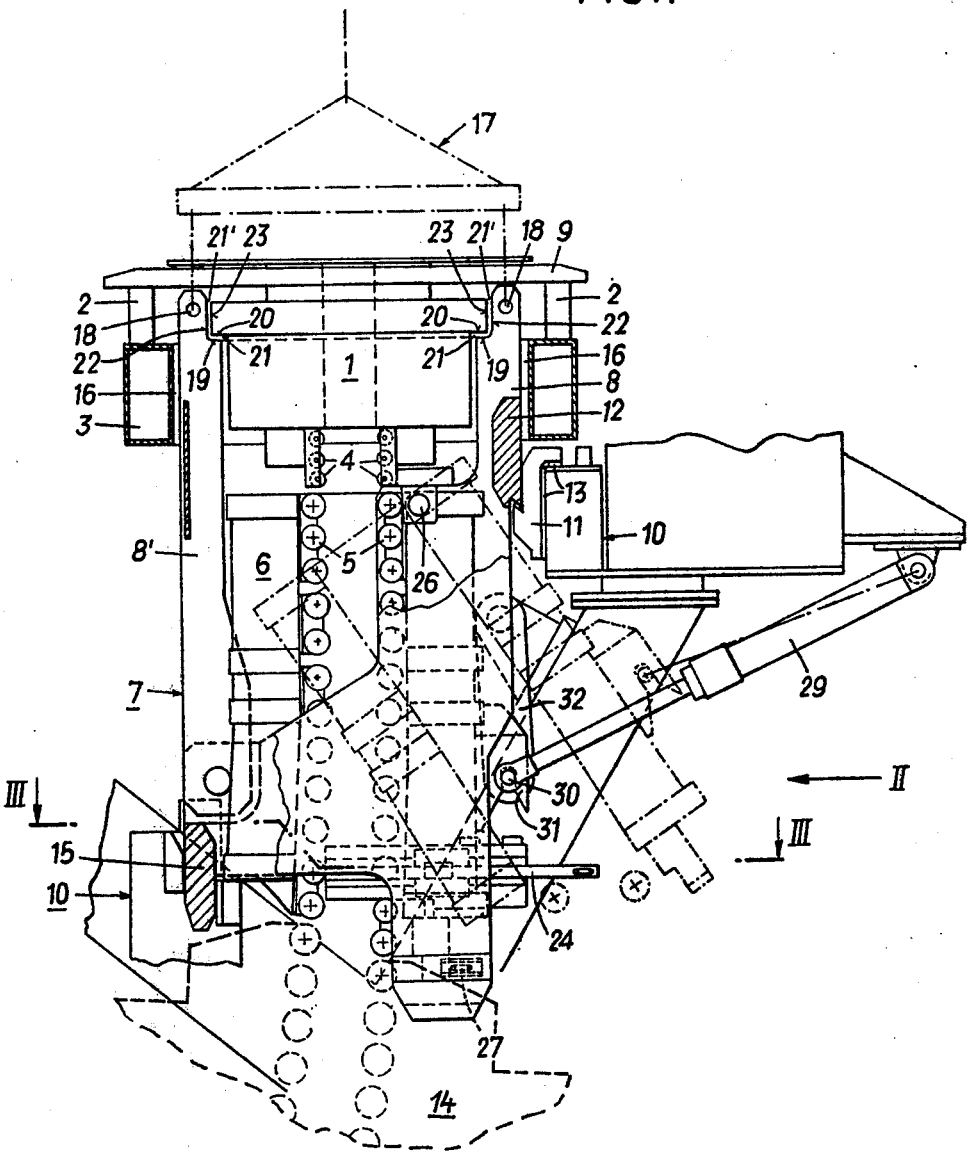
FIG. 1 is a view of the mould with the part of the strand guide following thereupon, partly in section, according to one embodiment.

By 1 a mould is denoted, which mould is in coolant flow-connection with a frame-shaped lifting table 3 and is mounted thereon by means of a plug-connection 2 which serves for the supply and drainage of water. Foot rollers 4 form a unit with the mould 1 and reciprocate therewith. During the casting procedure the lifting table is made to reciprocate by a reciprocating drive not shown. The cast strand emerging from the mould with a straight shape is deflected to a circular arc by part 6 of a strand guide following the mould and containing bending rollers 5. This strand guide part which subsequently will be called a bending zone, is arranged in a carrying frame 7, whose perpendicular supports 8 and 8' extend up to an upper rim 9 of the mould 1. The carrying frame 7 is mounted on a stationary steel structure 10 via hooks 11 in which an upper transverse carrier 12 of the carrying frame 7 engages. Each hook can be precisely adjusted by washers 13 insertable below its vertical and horizontal contacting faces with the steel structure 10, so that the carrying frame 7 can be precisely aligned to a strand guide part 14 following thereupon and indicated in FIG. 1 in broken lines.

A lower transverse carrier 15 located on the side of the carrying frame 7 arranged opposite the hooks 11, contacts the steel structure 10 without play. As can be seen from FIGS. 1 and 2, the carrying frame 7 is arranged with play 16 and 16' at all sides within the frame-shaped lifting table 3 and can be removed vertically upward through the lifting table 3 by means of a schematically illustrated lift-out means 17 with hooks not illustrated in detail. The hooks are engageable in recesses 18 of the perpendicular supports 8 and 8' of the carrying frame. The perpendicular supports 8 and 8' are provided with horizontal supporting faces 19, which are opposed by supporting faces 20 of the mould with a play 21 that allows for the reciprocating movement of the mould. As soon as the carrying frame 7 is lifted, the supporting faces 20 of the mould 1 come into contact with those of the supports 8 and 8'. When the carrying frame is further lifted, the mould is also lifted together therewith.

The supporting faces 19 and 20 and the adjacent vertical surfaces 22 and 23, which also oppose each other with play 21', are finely machined and serve as measuring surfaces for measuring the position of the mould 1 with respect to the bending zone 6. Two supports 8' on one side of the carrying frame 7 can be pivoted out, so that — when the carrying frame is removed — the bending zone 6 is easily accessible from one side.

Figure 3:
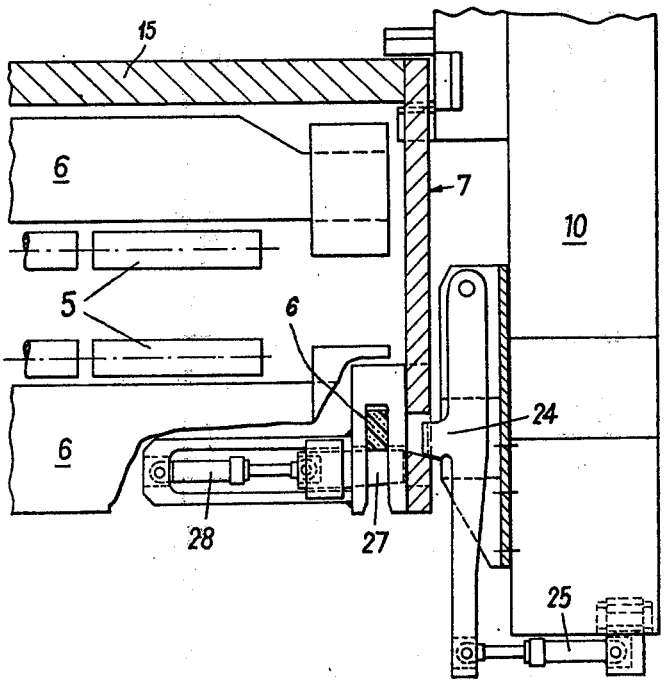
FIG. 3 is a section along line III—III of FIG. 1.

As can be seen from FIG. 3, the carrying frame 7 is fixed on the stationary steel structure 10 by bars 24 which can be actuated by means of pressure medium cylinders 25.

Figure 2:
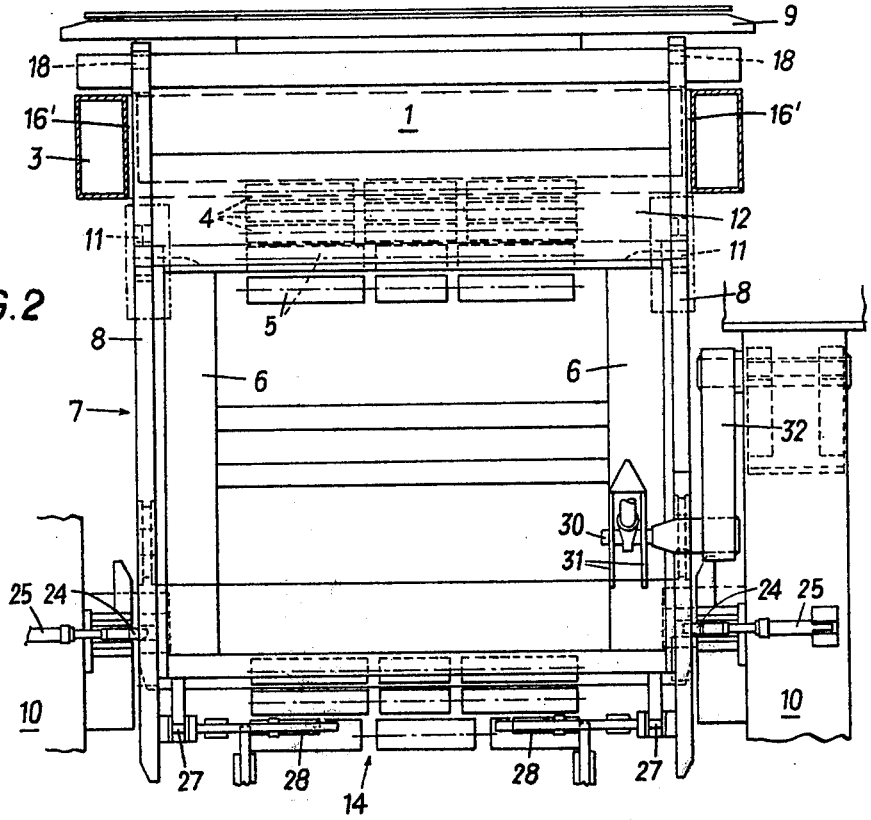
FIG. 2 shows a view in the direction of the arrow II of FIG. 1, also partly in section.

The bending zone is mounted in the carrying frame so as to be pivotable about a bolt 26 (FIG. 1), thereby freeing an introduction opening for the starter bar. The bending zone in the pivoted-out position is entered in FIG. 1 in dot-and-dash lines. In the operation position during the casting procedure, which is indicated in FIG. 1 in full lines, the bending zone can be fixed in the carrying frame 7 by means of wedge-shaped bars 27 which can be actuated by pressure medium cylinders 28 (FIG. 3).

A pressure medium cylinder 29 (FIG. 1) serves for pivoting the bending zone. It is hinged to the stationary steel structure 10 and is inserted with its piston rod end 30 in a downwardly open guide rail 31 that is secured to the bending zone. In addition, the piston rod end 30 is articulately connected with an arm 32 that is hinged to the steel structure 10 so that the piston rod end 30 is prevented from falling out of the guide rail 31. The downwardly open guide rail enables a lifting of the carrying frame 7 without necessitating a detachment of the piston rod of the pressure medium cylinder 29 from the bending zone 6. When the carrying frame is installed again, the piston rod end 30 slides by itself into the guide rail 31. Instead of the pressure medium cylinder 29 also a different adjustment drive, such as a threaded spindle or a toothed rack, can be provided.

Figure 4:
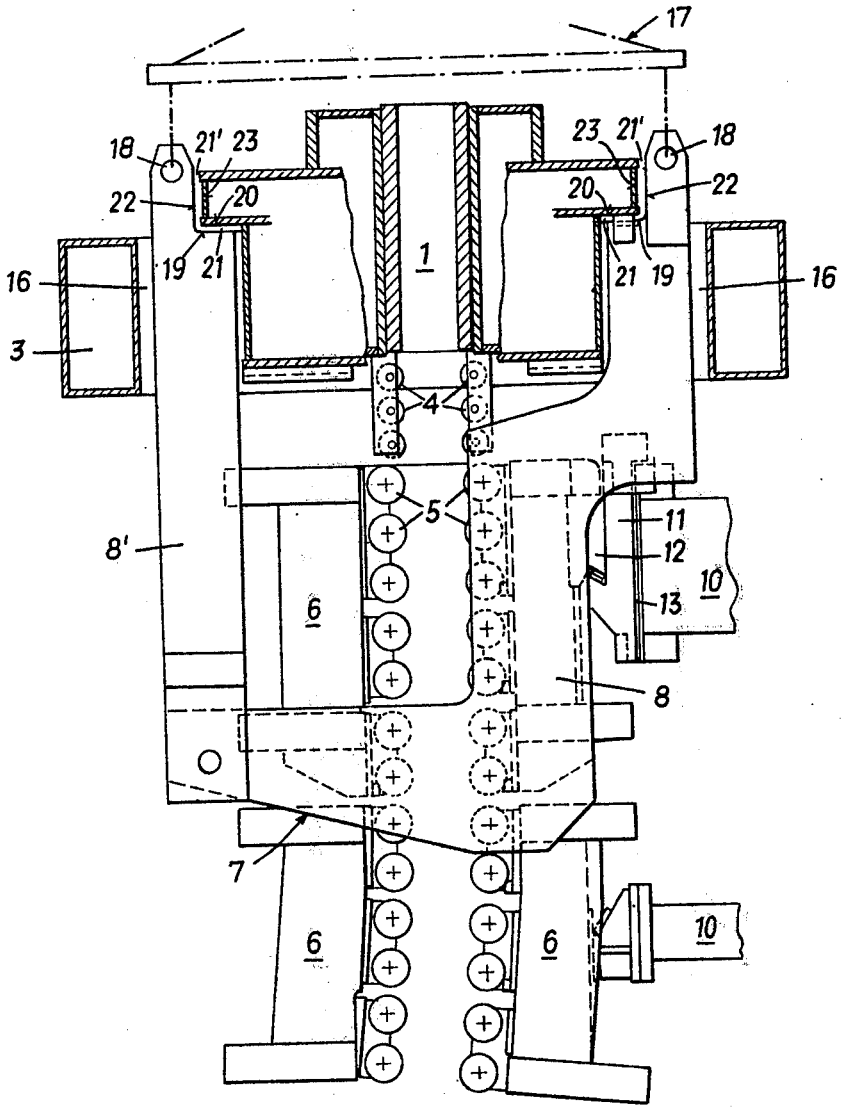
FIG. 4 shows a further embodiment of the arrangement according to the invention in an illustration analogous to FIG. 1.

According to FIG. 4 which shows a further embodiment according to the invention, the bending zone 6 is rigidly arranged in the carrying frame 7. This embodiment advantageously is used in continuous casting plants in which the starter bar is introduced into the strand guide through the mould.

We claim:

1. In a continuous casting plant of the type including a frame-shaped lifting table, a mould insertable in said lifting table and reciprocated by said lifting table, a strand guide means comprised of strand guide parts following the mould in the extraction direction and a carrying frame surrounding the strand guide part following the mould for removing the strand guide part from the plant, the improvement which is characterized in that the carrying frame, the strand guide part following the mould and the mould as a unit are installable in and removable from the continuous casting plant independent of the lifting table because said carrying frame is arranged with play within said frame-shaped lifting table and is vertically movable through the frame-shaped lifting table together with said strand guide part following the mould, and supporting faces are provided on said mould and on said carrying frame opposite each other with play, which supporting faces engage each other when the carrying frame is lifted so as to lift the mould along with the carrying frame.

2. A continuous casting plant as set forth in claim 1, wherein said mould has an upper rim and said carrying frame has an upper end portion extending up to said upper rim, and further including a lift-out means capable of engagement with said upper end portion of said carrying frame.

3. A continuous casting plant as set forth in claim 1, wherein said carrying frame and said strand guide part following the mould form a structural unit.

4. A continuous casting plant as set forth in claim 1, further comprising pivot means provided on the carrying frame for pivoting the strand guide part following the mould with respect to the carrying frame, thereby freeing an introduction opening for a starter bar.

5. A continuous casting plant as set forth in claim 4, wherein said pivot means for said strand guide part following the mould comprises:

a stationarily hinged adjustment drive having an end hinged to said strand guide part following the mould;

an arm pivotable about a stationary axis; and a downwardly open guide rail secured to said strand guide part following the mould, said end of said adjustment drive being articulately connected to said pivotable arm and being guided in said downwardly open guide rail.

6. A continuous casting plant according to claim 1, wherein the carrying frame includes supports forming a side of said carrying frame, said supports being pivotable transversely of the longitudinal axis of a strand cast therein.

7. A continuous casting plant as set forth in claim 1, wherein the supporting faces are vertical and horizontal finely machined faces on the carrying frame and the mould, said finely machined faces of the carrying frame opposing said finely machined faces of the mould with play.

* * * * *